US006095336A

United States Patent [19]

Redden et al.

[11] Patent Number: 6,095,336

[45] Date of Patent: Aug. 1, 2000

[54] FLOTATION CELL WITH RADIAL LAUNDERS FOR ENHANCING FROTH REMOVAL

[75] Inventors: Lorin Redden, Park City; Donald G. Foot, Jr., Fruit Heights; Jerry W. Hunt, Murray, all of Utah

[73] Assignee: Baker Hughes Incorporated, Houston, Tex.

[21] Appl. No.: 09/170,400

[22] Filed: Oct. 13, 1998

Related U.S. Application Data

[63] Continuation-in-part of application No. 08/920,800, Aug. 29, 1997, abandoned.

[51] Int. Cl.[7] ..... B03D 1/16; B03D 1/14

[52] U.S. Cl. ..... 209/169; 209/168

[58] Field of Search ..... 209/168, 169, 209/170

[56] References Cited

U.S. PATENT DOCUMENTS

| | | |
|---|---|---|
| 1,310,051 | 7/1919 | Blomfield . |
| 1,374,499 | 4/1921 | Greenawalt . |
| 3,342,331 | 9/1967 | Maxwell . |
| 3,491,880 | 1/1970 | Reck . |
| 3,701,421 | 10/1972 | Maxwell . |
| 3,701,451 | 10/1972 | Maxwell . |
| 3,802,569 | 4/1974 | Nagahama . |
| 3,993,563 | 11/1976 | Degner . |
| 4,247,391 | 1/1981 | Lloyd . |
| 4,311,240 | 1/1982 | Aurbach . |
| 4,737,272 | 4/1988 | Szatkowski et al. . |
| 5,039,400 | 8/1991 | Kallioinen et al. . |
| 5,219,467 | 6/1993 | Nyman . |
| 5,234,112 | 8/1993 | Valenzuela . |
| 5,251,764 | 10/1993 | Niitti et al. . |
| 5,431,286 | 7/1995 | Xu et al. . |
| 5,472,094 | 12/1995 | Szymocha et al. . |
| 5,542,546 | 8/1996 | Gotte et al. . |
| 5,611,917 | 3/1997 | Degner . |

FOREIGN PATENT DOCUMENTS

| | | |
|---|---|---|
| 865405 | 9/1981 | U.S.S.R. . |
| 93-20945 | 10/1993 | WIPO . |

*Primary Examiner*—Thomas M. Lithgow
*Attorney, Agent, or Firm*—Madan, Mossman & Sriram, P.C.

[57] ABSTRACT

A froth flotation cell comprising a tank and an impeller rotatably disposed in the tank for suspending solids and dispersing air in a pulp phase or slurry in the tank, thereby generating froth from the pulp phase. A plurality of radially oriented launders are placed near the top of the tank and have one end connected to an outer launder adjacent the outer periphery of the tank. A secondary launder, concentric with the outer launder may also be placed near the top of the tank and attached to the second ends of the radial launders. The secondary launder is attached to a dispersing mechanism located around the impeller. The secondary launder is in fluid communication with the radial launders, and the radial launders are likewise in fluid communication with the central launder. This provides a network of launders which collects froth at various locations throughout the flotation cell and causes rapid removal of froth from the flotation cell.

21 Claims, 3 Drawing Sheets

FLOTATION CELL WITH RADIAL LAUNDERS FOR ENHANCING FROTH REMOVAL

CROSS REFERENCE TO RELATED APPLICATIONS

This application is a continuation-in-part of U.S. patent application Ser. No. 08/920,800 filed Aug. 29, 1997, (now abandoned).

BACKGROUND OF THE INVENTION

1. Field of the Invention

This invention relates to froth flotation cells. More particularly, this invention relates to froth flotation cells utilized for removing mineral values from ore slurries. This invention provides froth flotation cells wherein greater collection surface area is provided through a network of launders to enhance the efficiency of froth collection. This invention also relates to an associated froth launder assembly and to a method for assembling a froth flotation cell.

2. Background of Prior Art

Froth flotation cells are used to separate mineral values from mineral wastes. An ore is finely ground and suspended as a water-based slurry or pulp in a flotation cell. An impeller or rotor is turned at a high speed in the slurry to suspend the mineral particulates and to distribute or disperse air bubbles into the slurry. The mineral values attach to the air bubbles. The bubbles with the entrained mineral values then rise to form a froth atop the pulp or slurry pool. The froth overflows a weir and is collected in a launder for further processing. Examples of flotation cells are described in U.S. Pat. No. 5,611,917 to Degner, U.S. Pat. No. 4,737,272 to Szatkowski et al., U.S. Pat. No. 3,993,563 to Degner, U.S. Pat. No. 5,219,467 to Nyman et al., U.S. Pat. No. 5,251,764 to Nitti et al., and U.S. Pat. No. 5,039,400 to Kallioninen et al. In the flotation machines of some of these references, air is supplied to the pulp or slurry via a separate pumping mechanism.

Commercially available flotation cells usually include a launder along the periphery of the flotation cell tank. Such cells are limited in their froth removal capabilities as the froth must travel to the periphery of the tank before being collected by the launder. It is therefore desirable to provide a more efficient manner of removing the froth from the tank.

During flotation cell operation, the rotation of the impeller imparts rotational energy to the pulp or slurry pool. This rotational energy is transferred to the froth phase, which develops angular velocity in the slurry. This angular velocity increases the time to remove the froth and can cause the mineral values to drop back into the pulp phase, thus reducing the efficiency of the flotation cell. Reducing the angular velocity and increasing the radial velocity of the fluid mass in the tank can increase the overall effectiveness of the flotation cell. U.S. application Ser. No. 08/920,800 assigned to the assignee of this application discloses an apparatus and method for reducing the angular velocity of the pulp slurry through the use of radially disposed baffle plates. U.S. application Ser. No. 08/920,800 is incorporated herein by reference.

The present invention addresses the above-noted deficiencies and provides flotation cells with a network of launders that removes froth from throughout the tank. Additionally, baffle plates are provided in the tank to reduce the angular velocity of the slurry, thereby increasing the efficiency of the flotation cell.

SUMMARY OF THE INVENTION

The current invention is based on the observation that flotation cells are limited by their associated froth removal capabilities. If froth is not removed quickly and efficiently, mineral values tend to drop back into the pulp phase and then either attach once again to air bubbles or are discharged with mineral waste. Thus, the higher the rate of froth removal, the greater the efficiency of the flotation cell.

Accordingly, the present invention is directed toward achieving the goal of increasing the rate of froth removal regardless of froth flow characteristics such as angular and radial components of the froth velocity or momentum. Preferably, such a structure is simple, inexpensive to build and operate and finally is retrofittable to existing flotation cells.

A froth flotation cell comprises, in accordance with the present invention, a tank and an impeller or other mechanism disposed in the tank for suspending solids and dispersing air in a pulp phase or slurry in the tank while also aiding in the generation of froth from the pulp phase or slurry. An outer launder (also referred to herein as the "central" or "main" launder) is placed near the top of the tank and along the periphery of the tank. A plurality of radial launders have one end attached to the outer launder and extend generally inwardly from the outer launder toward the center of the tank. In addition to radial launders, a secondary launder (also referred to herein as the "inner" launder) may be placed circumferentially and around a dispersing mechanism in the tank near the center of the tank.

Generally, the launders are fastened together in a manner so that the secondary launder is in fluid communication with the radial launders, and in turn the radial launders are in fluid communication with the outer launder. This creates a network of launders and thus a network of fluid channels, all leading to the outer launder for disposal of the collected froth. Preferably, the radial launders are circumferentially equispaced.

The secondary launder may be connected to the dispersing mechanism by a simple bracket assembly that includes a series of vertical members or posts attachable to the dispersing mechanism. The various launders are connected to each other with a flange-type bracket and conventional fasteners. Fluid communication from one launder to the next is facilitated by creating cutouts at the connecting points of the launders. Gaskets between the flanged faces of the connecting launders create liquid-tight seals throughout the network of launders. Any other suitable method may be utilized to inter-connect the various launders provided for in the present invention.

In the present invention, each individual launder is provided with a froth overflow lip which then determines the level of the froth in the tank. The launders are assembled to preferably make their associated overflow lips coplanar throughout the tank. The overflow lips, however, could be arranged in a non-coplanar fashion in order to take advantage of fluid froth flow dynamics associated with a particular flotation cell design.

In the present invention, a wash assembly is placed so as to introduce a sprayed liquid at various points in the secondary launder. The introduction of a liquid at these points accelerates the flow of the froth as it travels through the secondary and radial launders to the outer launder. This expedites the overall removal of the froth.

In another embodiment, a second wash assembly may be placed so as to introduce a sprayed liquid at predetermined locations in the radial launders to increase the rate of flow of the froth as it travels through such launders.

In the present invention, one or more baffles may be disposed in the tank to reduce the angular velocity of the pulp phase. The use of baffles aids in froth removal and thus the mineral recovery from the ore slurry. The flotation cells according to the present invention, however, may omit the use of baffles.

For clarity in explaining the present invention, the flotation cell is described without a crowder device. A crowder device is commonly used to direct froth flow radially outward in the tank. Those skilled in the art will recognize that other embodiments consistent with the present invention would include the addition of a crowder device.

A flotation cell according to the present invention has an increased froth removal rate, owing to the placement of launders throughout the tank which remove the froth, regardless of the froth flow dynamics (angular components, radial components, or a combination of such components).

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1:
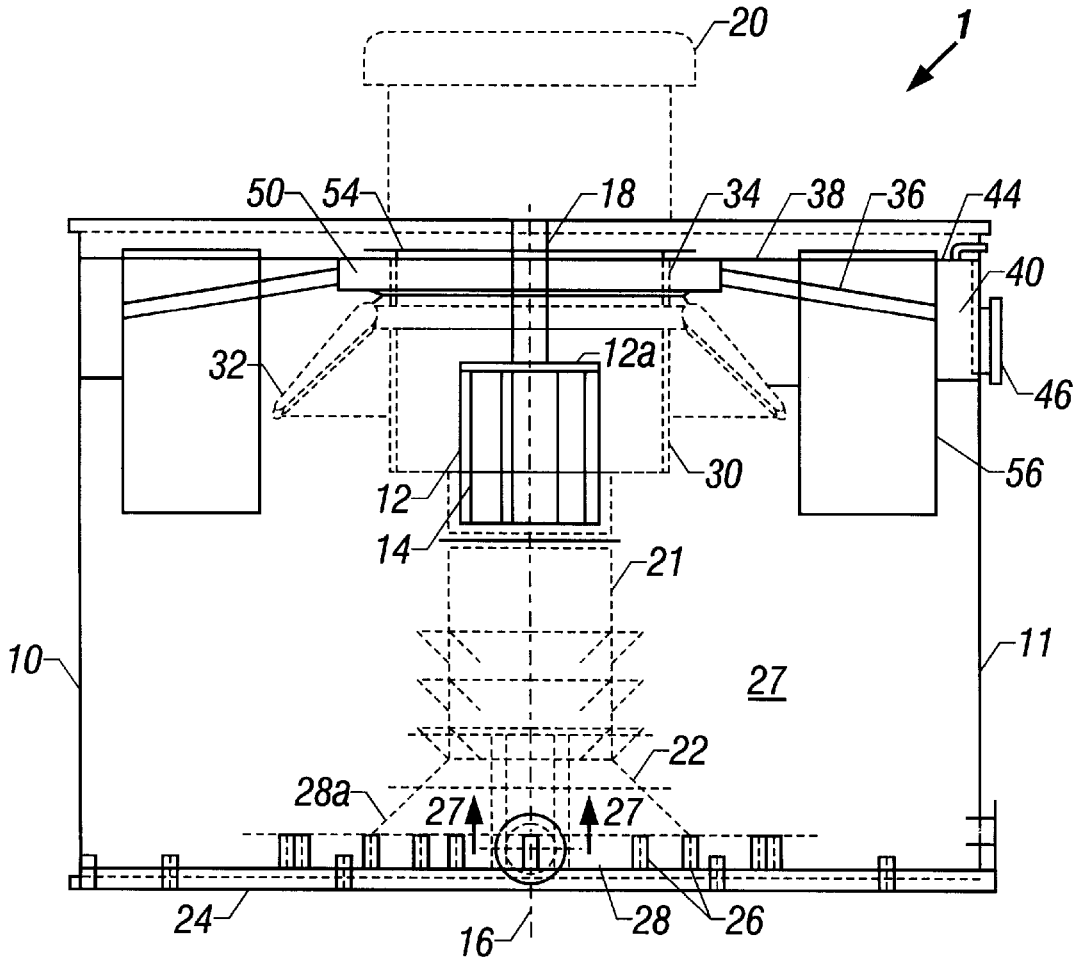
FIG. 1 is a partial side elevational view, partially in phantom lines, of a froth flotation cell in accordance with the present invention, containing a network of launders that includes: a central launder, two of a plurality of radial launders, a secondary circumferential launder, and a plurality of baffle plates.

FIG. 1 shows an embodiment of a froth flotation cell according to the present invention that includes a tank 10 and an impeller or rotor 12 rotatably disposed in the tank 10 for generating froth from a pulp phase or slurry in the tank 10. The impeller 12 includes a plurality of vertical vanes or propeller blades 14 disposed in a generally cylindrical configuration about a rotation axis 16. The impeller 12 is connected to a vertically oriented drive shaft 18, which is drivingly coupled at an upper end to a drive assembly 20 that includes a conventional motor, transmission belts, and bearings (none shown).

The lower end of the impeller 12 is surrounded by an upper end of a cylindrical draft tube extension or spacer element 21, which is coupled at its lower end to a conical draft tube 22. The draft tube 22 is spaced from a lower wall or panel 24 of tank 10 by a plurality of support members 26. The support members 26 define a plurality of openings 28 through which pulp or slurry 27 moves and is drawn into the draft tube 22.

The upper end 12*a* of the impeller 12 is surrounded by a perforated dispenser 30, coaxially aligned with the drive shaft 18, and acts to facilitate shearing of air bubbles and to eliminate vortexing of the pulp phase. Positioned over and about the disperser 30 is a perforated conical hood 32 for stabilizing the pulp phase. The impeller 12 is positioned near the top of the fluid volume and the hood 32, which functions to reduce turbulence in the slurry 27.

Although not shown in the embodiment of FIG. 1, a crowder device is usually placed above the hood 32 and impeller 12. The structure and function of a crowder device is described in U.S. Pat. No. 5,661,917 to Degner, which is hereby incorporated by reference. The disclosures of U.S. Pat. No. 4,737,272 to Szatkowski et al. and U.S. Pat. No. 3,993,563 to Degner are also incorporated by reference.

Above the disperser 30 is a standpipe 34 through which air is mixed into the pulp or slurry 27. During operation, the impeller 12 creates a vortex within the standpipe 34 which allows for mixing and entrainment of air into the pulp or slurry 27.

Attached to the inside wall 11 of the tank 10 are a plurality of baffles 56. The baffles 56 are plates which are preferably circumferentially or angularly equispaced and mounted substantially in a radial and vertical direction. The impeller 12 motion causes the slurry 27 (or fluid mass) to move radially (or in an angular motion), which tends to reduce the effectiveness of the flotation cell 1. The use of baffles is described in co-pending U.S. patent application Ser. No. 08/920,800, which is incorporated in writing. The purpose of the baffles is to decrease the angular movement of the slurry mass 27 and to increase the radial movement of the slurry mass 27.

Figure 2:
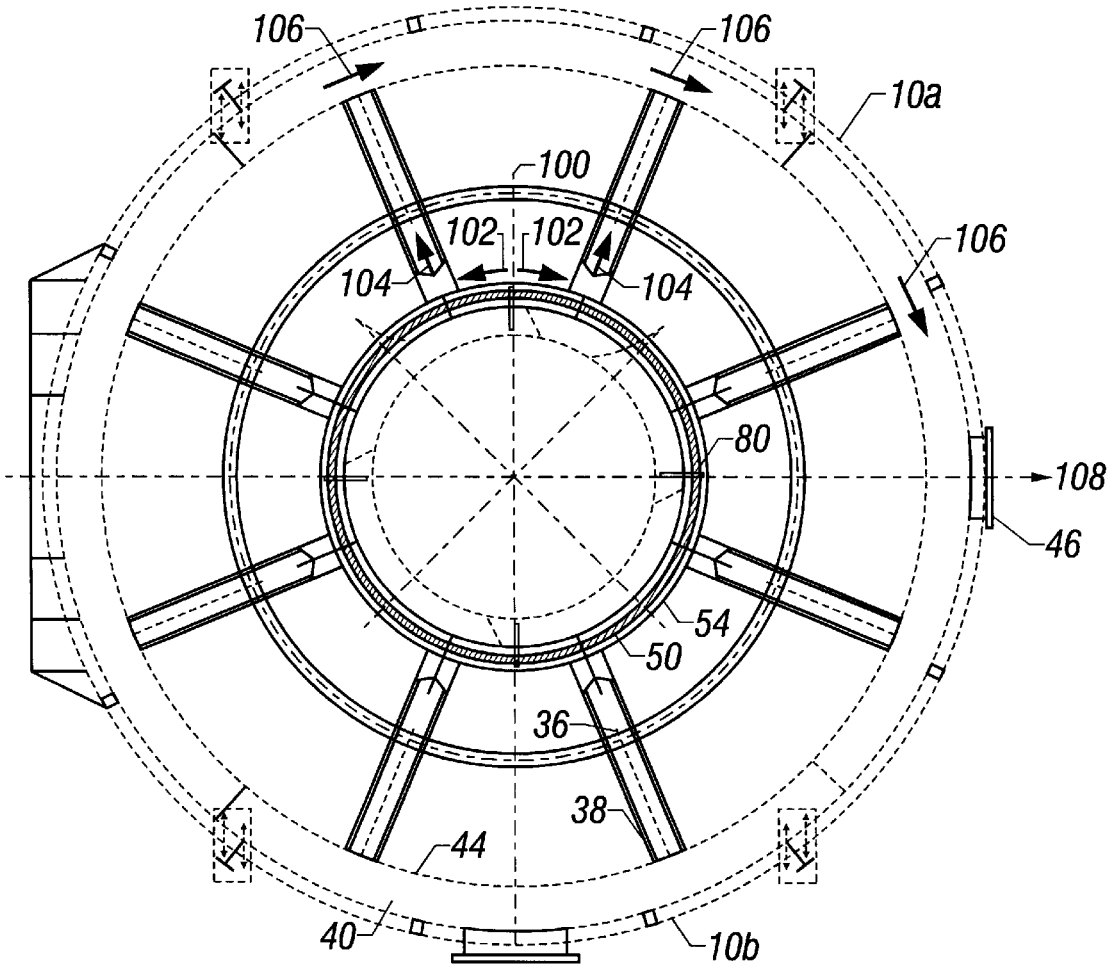
FIG. 2 is a partial top plan view of the froth flotation cell of FIG. 1, showing the central launder, secondary launder, plurality of radial launders and a wash assembly.

As illustrated in FIGS. 1 and 2, the froth flotation cell 1 also includes an outer launder 40 (also referred to herein as the "central" or "main launder") at or adjacent to an outer periphery of the tank 10. The outer launder 40 is fixed preferably near the upper end around the inside periphery of the tank 10. The outer launder 40 may, however, be disposed at the outer side 10*b* of the tank 10. An overflow lip 44 of the outer launder 40 defines or determines the froth level, which is generally located slightly above the vertical position of the overflow lip 44.

In the present invention, one or more radial launders, such as launders 36, are connected at their one end to the outer launder 40, and extend inward therefrom. The radial launders 36 are preferably circumferentially or angularly equispaced. Each radial launder 36 has an overflow lip 38 similar to the central launder's overflow lip 44. The central launder's overflow lip 44 and each radial launder's overflow lip 38 are aligned in a coplanar fashion so that the definition or determination of the froth level initially set by the central overflow lip 44 is unchanged.

A secondary launder (also referred to as the "inner" launder) 50 may be disposed in the tank 10 and inside the outer launder 40. If a secondary launder 50 is utilized, then each radial launder 36 preferably has its second end connected to a secondary launder 50. The secondary launder 50 is preferably concentric with and of smaller diameter than the outer launder 40. The secondary launder 50 also has an overflow lip 54, which is coplanar with the radial launder overflow lips 38 and the outer launder overflow lip 44. The secondary launder 50 may be structurally attached to the standpipe 34 by using a plurality of brackets 60 as shown in FIG. 3*c*.

Figure 3A:
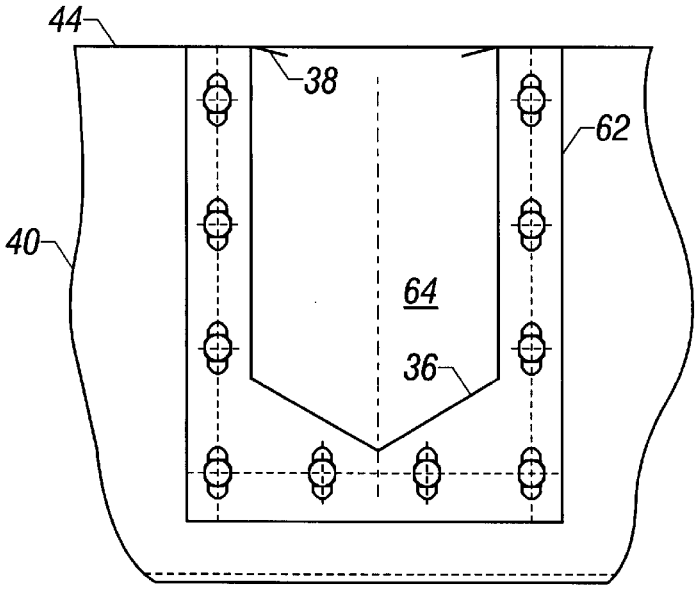
FIG. 3*a* is an elevational view taken along the axis of a radial launder showing the connection between a radial launder and the central launder.
Figure 3B:
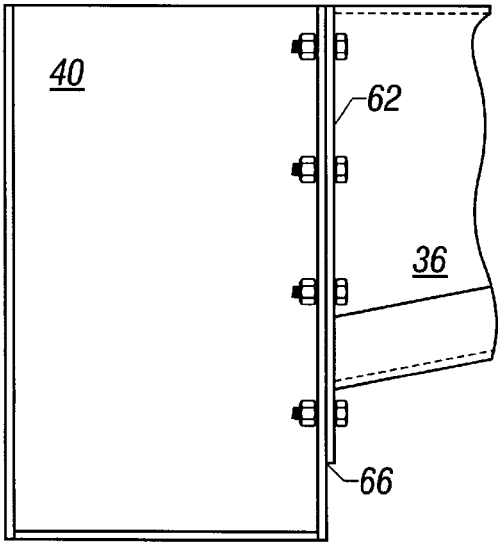
FIG. 3*b* is a side elevational view, perpendicular to the axis of a radial launder, showing the connection between a radial launder and the central launder.

Referring to FIGS. 3*a* and 3*b*, the radial launders 36 are connected to the central launder 40 by flange-type brackets 62. A cutout 64 in the wall of outer launder 40 is provided in order to create a continuous fluid path from the radial launder 36 to the outer launder 40. In between the radial launder 36 and the outer launder 40 is a gasket 66 which prevents fluid from leaking either in or out of the radial launders 36 and the outer launder 40.

Figure 3C:
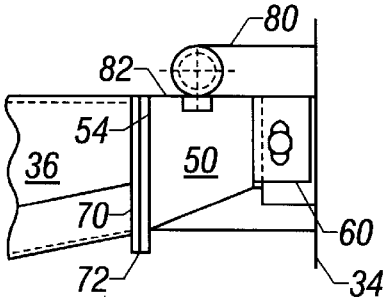
FIG. 3*c* is a side elevational view, perpendicular to the axis of a radial launder, showing the connection of a radial launder to the secondary circumferential launder, the connection of the secondary circumferential launder to the standpipe of the flotation cell and a wash assembly positioned in the secondary circumferential launder.

Referring to FIG. 3*c*, each radial launder 36 is similarly connected to the secondary launder 50 by another flange-type bracket 70 and a gasket 72 to prevent leakage. The connection between each radial launder 36 and the secondary launder 50 also includes a cutout (not shown) to allow for a continuous fluid path between each radial launder 36 and the inner launder 50.

Referring back to FIG. 1, each radial launder 36 is shaped so that it has a greater vertical depth at the connection with the outer launder 40 than it has at the connection with the secondary launder 50. This creates a slope in the bottom of the radial launder 36 that begins at the secondary launder 50 and continues downward until the connection at the outer launder 40.

The interconnections of launders 36, 40, and 50 described above create a network of launders which are in continuous fluid communication with each other. Froth which has been formed inside the tank 10 flows into the various launders via the overflow lips 38, 44, and 54. In this configuration, the froth may follow any of the various flow paths to reach the outer launder 40 and ultimately exit through a discharge pipe 46. For example, if the froth initially collects in the secondary launder 50, as shown by directional arrow 100 in FIG. 2, it will travel through the secondary launder 50 to one or more radial launders 36 as shown by directional arrows 102. This froth will continue down the radial launder(s) 36 as shown by directional arrows 104 into the central launder 50. The froth flows through the central launder 50 as shown by directional arrows 106, until it exits the discharge pipe 46 as indicated by directional arrow 108. Froth can also initially enter into one of the radial launders 36 or even the outer launder 40 and then follow a similar but shorter path depending on the initial point of overflow. The froth is carried from one launder to the next by gravity based on the slope of the radial launders 36.

The configuration of the launders described above provides a greater surface area for collecting froth throughout the tank 10, which allows faster collection of the froth and then the discharge from the tank 10 compared to launders which do not use radial and/or secondary launders. This enhances the effectiveness of the flotation cell 1. It has been determined that eight radial launders such as launders 36 and one secondary launder, such as launder 50, are sufficient for a majority of flotation cells. A lesser number of radial launders 36 may be utilized. Additionally, a flotation cell may be built without a secondary launder 50.

To further aid in the removal of the froth once the froth has entered into the network of launders, a wash assembly 80 may be provided. The wash assembly 80 contains a plurality of spray nozzles 82 which, in the present embodiment, are placed so as to introduce a fluid (which is innocuous to, and compatible with, the mineral value recovery process) at various points in the secondary launder 50, see FIG. 3*c*. The introduction of a fluid at these locations, in essence, reduces the viscosity of the froth and allows the froth to travel more rapidly from the secondary launder 50 to the radial launders 36 and then to the central launder 50. Thus, the use of a wash assembly 80 expedites the removal of froth collected in the secondary launder 50. This also allows the use of radial launders 36 with shallower slope.

An additional wash assembly (not shown) may be placed so as to introduce sprayed liquid at a predetermined location in the radial launders 36 to further increase the flow rate of froth through the radial launders 36.

An advantage of providing a network of launders such as described above, is that the froth is removed from the tank 10 efficiently regardless of the froth flow characteristics. For example, if froth is flowing with an angular momentum, then the froth is captured by the radial launders 36. Likewise, if the flow of the froth is either radially outward from the center of the tank, or radially inward towards the center of the tank, the froth is collected by either the outer launder 40 or the secondary launder 50 respectively.

The present invention also is applicable to any type of froth flotation cell regardless of the mechanism (e.g. a pump) used to suspend mineral particulates and disperse air bubbles into the slurry. Thus, a froth flotation cell without a rotating impeller 12, draft tube 22, disperser 30, or hood 32 can benefit from the system of launders made according to the present invention.

Although the invention has been described in terms of particular embodiments and applications, one of ordinary skill in the art can design additional embodiments and make modifications without departing from the spirit of or exceeding the scope of the claimed invention.

Accordingly, it is to be understood that the drawings and description herein are provided by way of example to facilitate comprehension of the invention and should not be construed to limit the scope thereof.

What is claimed is:

1. A flotation cell for removing mineral values present in a slurry, comprising:

a tank for holding a mass of the slurry containing said mineral values;

a mechanism in the tank introducing gas into the slurry and generating froth near the top of the mass of the slurry;

a launder adjacent a periphery of the tank constituting an outer launder, said outer launder removing froth from the tank during operation of the flotation cell;

an inner launder in the tank that is of a size smaller than the outer launder and disposed generally toward the center of the tank said inner launder collecting froth from the tank; and at least one radial launder in the tank, said radial launder extending from adjacent said outer launder generally inwardly toward an inner portion of said tank, said at least one radial launder receiving froth from the tank and is in fluid flow communication with the outer launder and the inner launder to enhance recovery of froth from the tank.

2. The flotation cell of claim 1, further comprising a plurality of radial launders disposed in the tank.

3. The flotation cell of claim 2, wherein said radial launders are arranged circumferentially equispaced.

4. The flotation cell of claim 1, wherein said outer launder includes an upper lip that defines the level of the froth in the tank.

5. The flotation cell of claim 4, wherein the at least one radial launder includes a lip coplanar with the lip of the outer launder.

6. The flotation cell of claim 1, wherein at least one radial launder discharges the received froth into the outer launder.

7. The flotation cell of claim 1, wherein said radial launder, inner launder, and outer launder each have a, generally coplanar lip defining the level of froth in the tank.

8. The flotation cell of claim 1, wherein the inner launder discharges the froth into the at least one radial launder.

9. The flotation cell of claim 1, further having a device for delivery of wash liquid to at least one of the inner or radial launders to enhance flow of froth through the radial launder.

10. The flotation cell of claim 2, further comprising a device for delivery of wash liquid to at least one of the outer or radial launders to enhance flow of froth through said radial launder.

11. A flotation cell for recovering mineral values contained in a slurry, comprising:

a tank for receiving and holding a mass of the slurry;

a mechanism in the tank adjacent the middle of the tank introducing gas and creating froth containing mineral values near top of the slurry mass in the tank;

a launder adjacent a periphery of the tank constituting an outer launder, said outer launder removing froth from the tank during operation of the flotation cell;

an inner launder in the tank, said inner launder substantially surrounding said mechanism, said inner launder receiving froth from the tank and discharging the received froth from the tank to enhance removal of the froth from the tank; and at least one radial launder in the tank, said radial launder extending from adjacent said outer launder generally inwardly toward an inner portion of said tank, said at least one radial launder receiving froth from the tank and in fluid flow communication with the outer launder and the inner launder to enhance recovery of froth from the tank.

12. The flotation cell of claim 1, further comprising a plurality of generally radially oriented vertical baffles mounted in said tank for reducing angular momentum of said froth while enhancing radial momentum thereof.

13. The flotation cell of claim 1, further comprising at least one opening toward a lower end of said tank for delivery of slurry to said tank.

14. The flotation cell of claim 1, further comprising an impeller mounted for rotation in said tank, with said impeller being positioned generally toward an upper end of said tank and suspending solid particulates in the slurry upon rotation and inducing radial and angular motion of the slurry away from said impeller.

15. The flotation cell of claim 14, wherein said mechanism comprises an upper conduit for delivery of gas to said impeller for dispensing gas bubbles into the slurry to generate a froth of air, liquid and solid particulates that is of lower density than the slurry and thus raises toward the top of said tank.

16. The flotation cell of claim 14, further comprising a dispenser around said impeller and defining together with the inner periphery of said tank a flow channel for flow of the froth from said dispenser up to said outer launder.

17. The flotation cell of claim 1 wherein said at least one radial launder comprises a plurality of radial portions extending from adjacent said tank periphery generally toward the center of said tank.

18. The flotation cell of claim 12, wherein said baffles are mounted in said tank independent of direct attachment to the interior periphery of said tank.

19. The flotation cell of claim 12, wherein said baffles extend to an upper end and generally above a dispenser in said tank and a lower end generally below said disperser.

20. The flotation cell of claim 13, wherein said opening is positioned below a baffle and a impeller.

21. The flotation cell of claim 14, further comprising a draft tube extending from adjacent said lower end tank up to said impeller.

* * * * *